US008627768B2

(12) United States Patent
Smith

(10) Patent No.: US 8,627,768 B2
(45) Date of Patent: Jan. 14, 2014

(54) BALL MARKING DEVICE

(76) Inventor: Byron Smith, South Hero, VT (US)

( * ) Notice: Subject to any disclaimer, the term of this patent is extended or adjusted under 35 U.S.C. 154(b) by 241 days.

(21) Appl. No.: 13/028,321

(22) Filed: Feb. 16, 2011

(65) Prior Publication Data

US 2011/0206850 A1 Aug. 25, 2011

Related U.S. Application Data

(60) Provisional application No. 61/306,296, filed on Feb. 19, 2010.

(51) Int. Cl.

| | |
|---|---|
| ***B41F 17/00*** | (2006.01) |
| ***B43L 9/00*** | (2006.01) |
| ***B43L 13/00*** | (2006.01) |
| ***B05C 11/00*** | (2006.01) |

(52) U.S. Cl.
USPC ..... 101/35; 33/18.1; 33/21.1; 118/504

(58) Field of Classification Search
None
See application file for complete search history.

(56) References Cited

U.S. PATENT DOCUMENTS

| | | | | |
|---|---|---|---|---|
| 676,506 | A | 6/1901 | Knight | |
| 849,600 | A | 4/1907 | Cory | |
| 1,537,685 | A | 5/1925 | Ladd | |
| 1,842,944 | A | 1/1932 | O'Brien | |
| 2,002,847 | A | 5/1935 | Atti | |
| 2,005,787 | A | 6/1935 | Humphrey | |
| 2,720,163 | A | 10/1955 | Shukal | |
| 3,019,762 | A | 2/1962 | Haute | |
| 3,071,171 | A | 1/1963 | Guerrero | |
| 4,086,851 | A | 5/1978 | Brandell | |
| D249,089 | S | 8/1978 | Studley | |
| 5,743,180 | A | 4/1998 | Arnke | |
| 5,795,249 | A | 8/1998 | Johnson | |
| 5,878,659 | A | 3/1999 | Hatter | |
| 5,925,186 | A | 7/1999 | Klimek | |
| 6,004,223 | A | 12/1999 | Newcomb | |
| 6,209,452 | B1 | 4/2001 | Klimek | |
| 6,213,012 | B1 | 4/2001 | Arms | |
| 6,216,587 | B1 | 4/2001 | Foley | |
| 6,324,971 | B1 | 12/2001 | Urban | |
| 6,453,807 | B1 | 9/2002 | Ramey | |
| 6,595,128 | B2 | 7/2003 | Parks | |
| 6,676,544 | B2 | 1/2004 | Tyke | |
| 6,716,112 | B2 | 4/2004 | Rennecamp | |
| D497,948 | S | 11/2004 | Miller | |
| 6,829,989 | B2 | 12/2004 | Chudy | |
| 6,862,984 | B2 | 3/2005 | Sosin | |
| D508,078 | S * | 8/2005 | Caramico | D19/40 |
| 7,047,877 | B2 | 5/2006 | Downey | |
| D525,300 | S | 7/2006 | Helmstetter | |
| D531,248 | S | 10/2006 | Burnett | |
| D542,875 | S | 5/2007 | Rankin | |
| D558,291 | S * | 12/2007 | Burnett | D21/789 |
| 2005/0255940 | A1 | 11/2005 | Tebbe | |
| 2007/0144363 | A1 * | 6/2007 | Carroll et al. | 101/35 |

* cited by examiner

*Primary Examiner* — Dah-Wei Yuan
*Assistant Examiner* — Jethro Pence
(74) *Attorney, Agent, or Firm* — James Marc Leas

(57) ABSTRACT

A device for marking a ball includes a stencil ring and a housing. The housing includes a base and a top. The base includes a base quick connecting element. The top includes a top quick connecting element. The base and said top quick connecting elements are for connecting and disconnecting the base to the top. The housing encloses the stencil ring when the base and the top quick connecting elements are connected. The stencil ring includes stencil symbols. The base and the top are sized to hold the ball for marking with the stencil symbols when the base and top quick connecting elements are connected.

34 Claims, 11 Drawing Sheets

BALL MARKING DEVICE

RELATED APPLICATIONS AND PRIORITY

This patent application claims the benefit of U.S. provisional patent application 61/306,296 filed Feb. 19, 2010, entitled "Ball Marking Device" incorporated herein by reference.

FIELD

This patent application generally relates to a ball marking device. More particularly it relates to a device for stenciling marks and writing on a ball.

SUMMARY

One aspect of the present patent application is a device for marking a ball. The device includes a stencil ring and a housing. The housing includes a base and a top. The base includes a base quick connecting element. The top includes a top quick connecting element. The base and said top quick connecting elements are for connecting and disconnecting the base to the top. The housing encloses the stencil ring when the base and the top quick connecting elements are connected. The stencil ring includes stencil symbols. The base and the top are sized to hold the ball for marking with the stencil symbols when the base and top quick connecting elements are connected.

Another aspect of the present patent application is a device for marking a ball. The device includes a housing and a stencil ring. The housing holds the stencil ring and the ball. The stencil ring includes a fixed positioning structure that provides incremental positioning. The housing includes a first element allowing the stencil ring to rotate between fixed positions defined by said fixed positioning structure. The housing includes a second element for holding the ball from rotating. The stencil ring includes a plurality of stencil symbols for marking the ball.

Another aspect of the present patent application is a method of marking a ball with a marker. The method includes providing a housing and a stencil ring. The housing includes a base and a top. The stencil ring is in the housing. The stencil ring includes a first stencil symbol and a second stencil symbol. The ball fits in the stencil ring and in the housing. The method includes inserting the ball into the housing wherein the housing includes an element to hold the ball from rotating. The method also includes rotating the stencil ring to position the first stencil symbol on the ball. The method also includes using a marker and the stencil ring to mark the first stencil symbol on the ball.

BRIEF DESCRIPTION OF THE DRAWINGS

The foregoing will be apparent from the following detailed description as illustrated in the accompanying drawings, for clarity not drawn to scale, in which.

DETAILED DESCRIPTION

Figure 1:
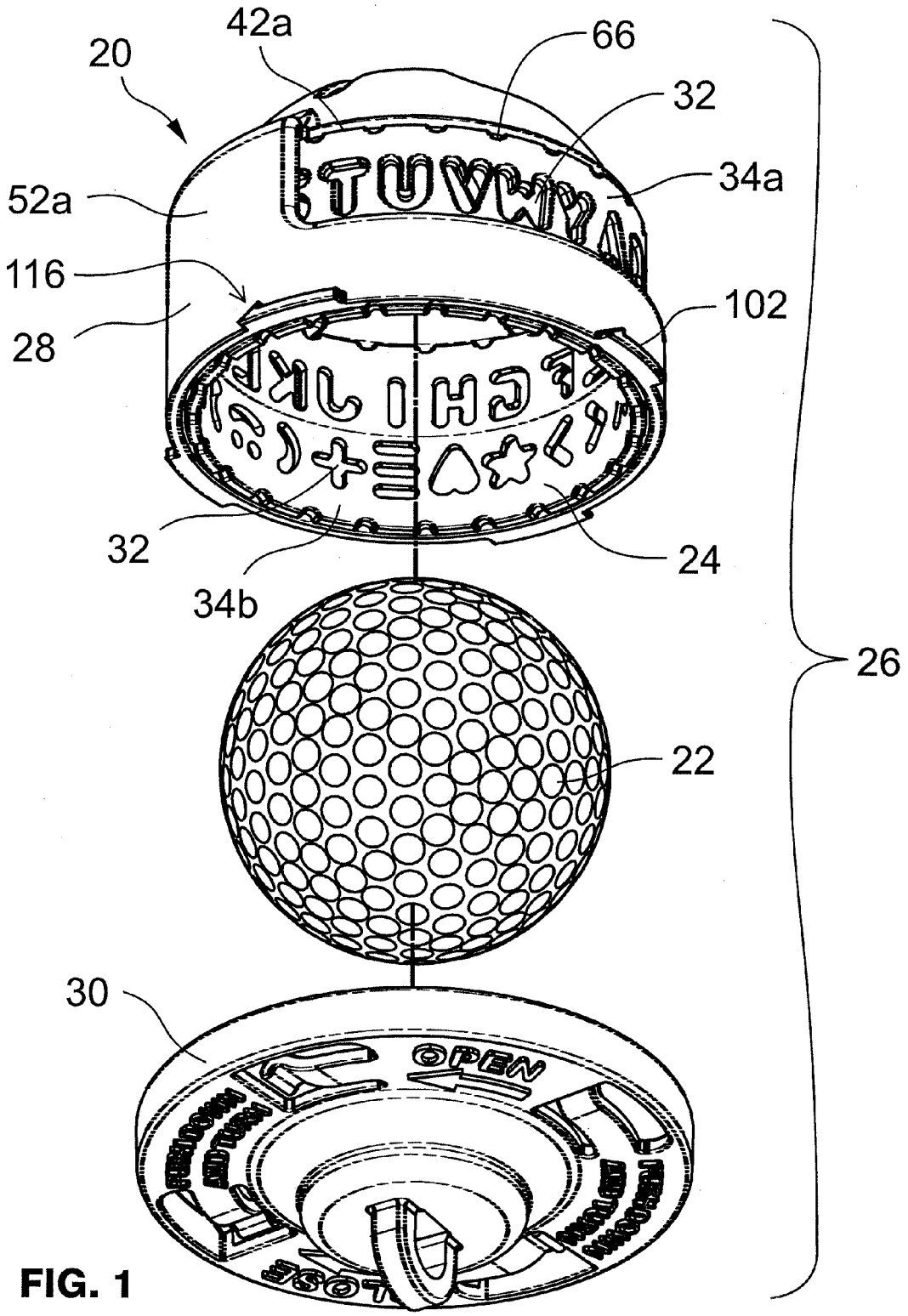
FIG. 1 is an exploded three dimensional view of one embodiment of the housing and the stencil ring of a ball marking device along with a golf ball.
Figure 2A:
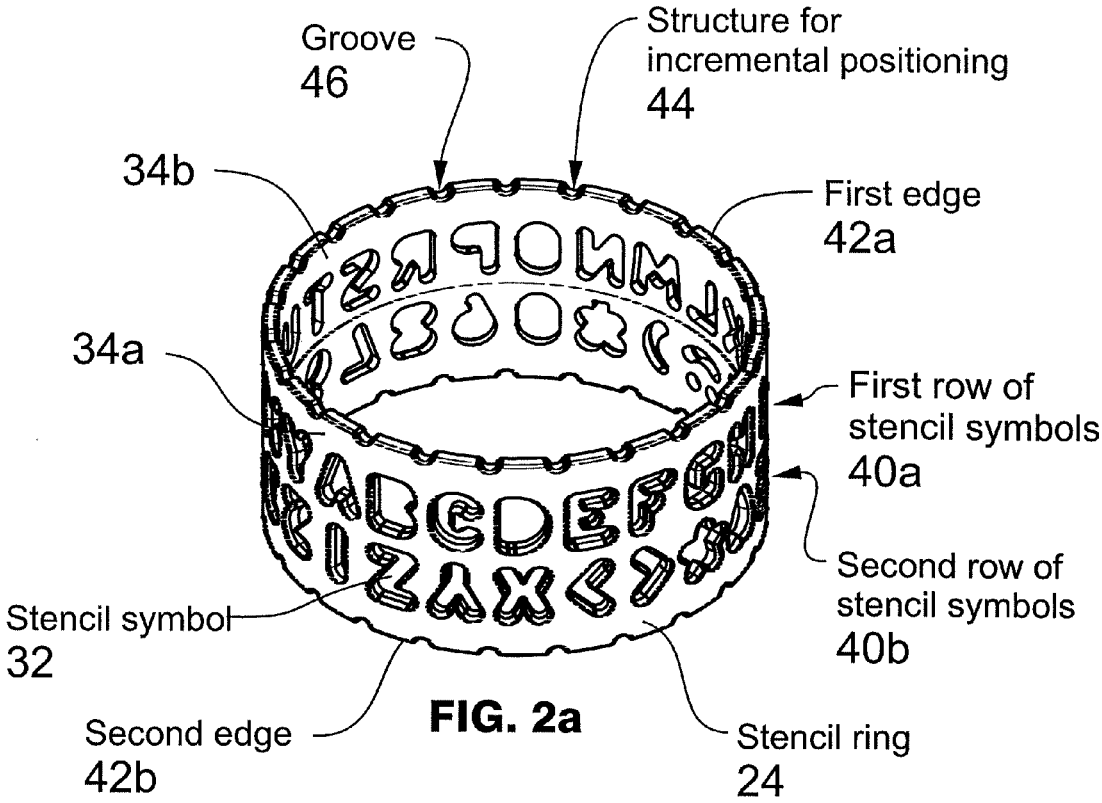
FIGS. 2*a* and 2*b* are three dimensional views of one embodiment of replaceable stencil rings for the ball marking device of FIG. 1.
Figure 2B:
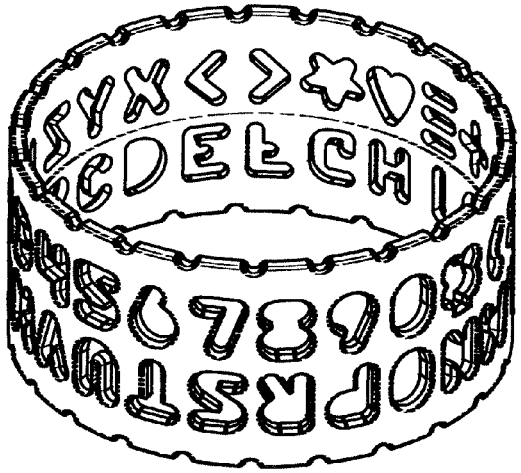

Ball marking device 20 for marking ball 22 includes stencil ring 24 and housing 26. Housing 26 includes top 28 and base 30, as shown in FIG. 1. Stencil ring 24 has a cylindrical shape and includes stencil symbol 32 extending through stencil ring 24 between stencil ring surfaces 34*a*, 34*b*, as shown in FIG. 1 and in FIGS. 2*a*, 2*b*. In one embodiment, a plurality of stencil symbols 32 are arranged in first row 40*a* and second row 40*b*. Fewer or more rows of stencil symbols 32 can also be used. In one embodiment, stencil symbols 32 in second row 40*b* are inverted with respect to stencil symbols 32 first row 40*a*, as shown in FIGS. 2*a*, 2*b*. In one embodiment, most often used letters are on first row 40*a* while least often used letters and other symbols are on second row 40*b*. Stencil ring 24, top 28 and base 30 can all be made of a plastic, such as polycarbonate.

Stencil ring 24 also includes first edge 42*a* and second edge 42*b*. Edges 42*a*, 42*b* each include structure for incremental positioning 44. In the embodiment shown in the figures, structure for incremental positioning 44 includes groove 46. A plurality of grooves 46 are included in this embodiment. Structure for incremental positioning 44, such as grooves 46, are for holding stencil ring 24 in a particular position while a particular stencil symbol 32 is being used to place a symbol on ball 22 located within stencil ring 24 within housing 26. Other structure for incremental positioning, such as elevated regions can be used instead of grooves 46. If a structure for incremental positioning is omitted then the user could hold the stencil ring with a finger while marking.

Figure 3A:
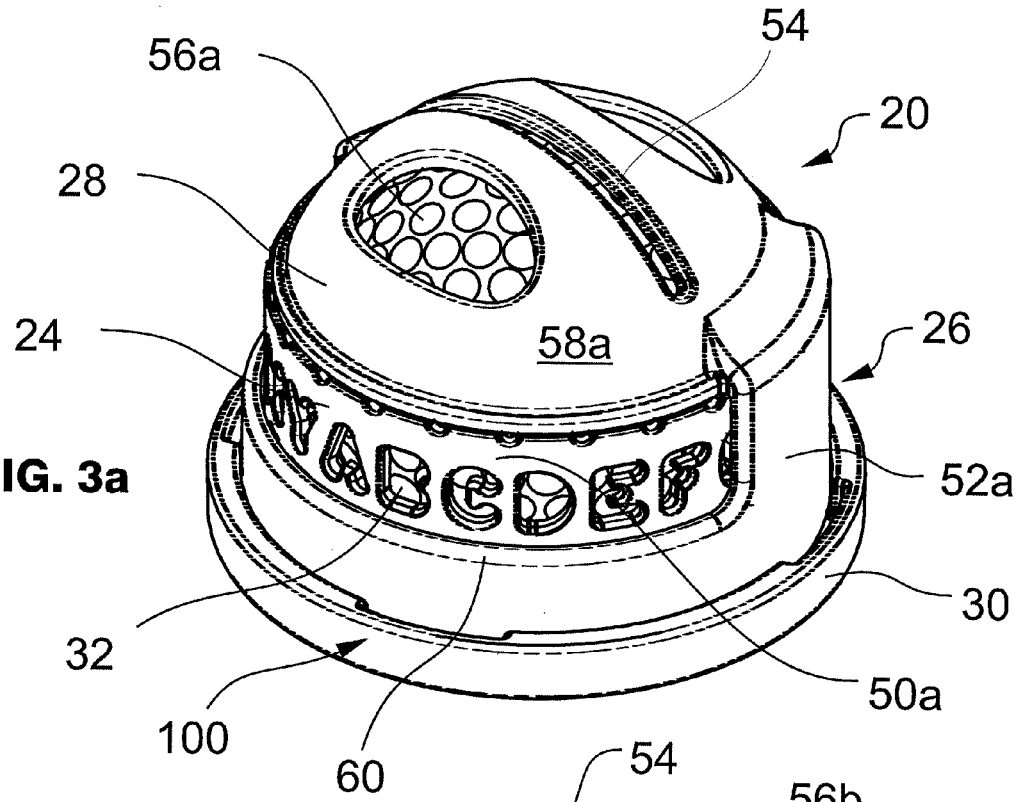
FIGS. 3*a* and 3*b* are three dimensional views of the housing and stencil ring of the ball marking device and ball of FIG. 1.
Figure 3B:
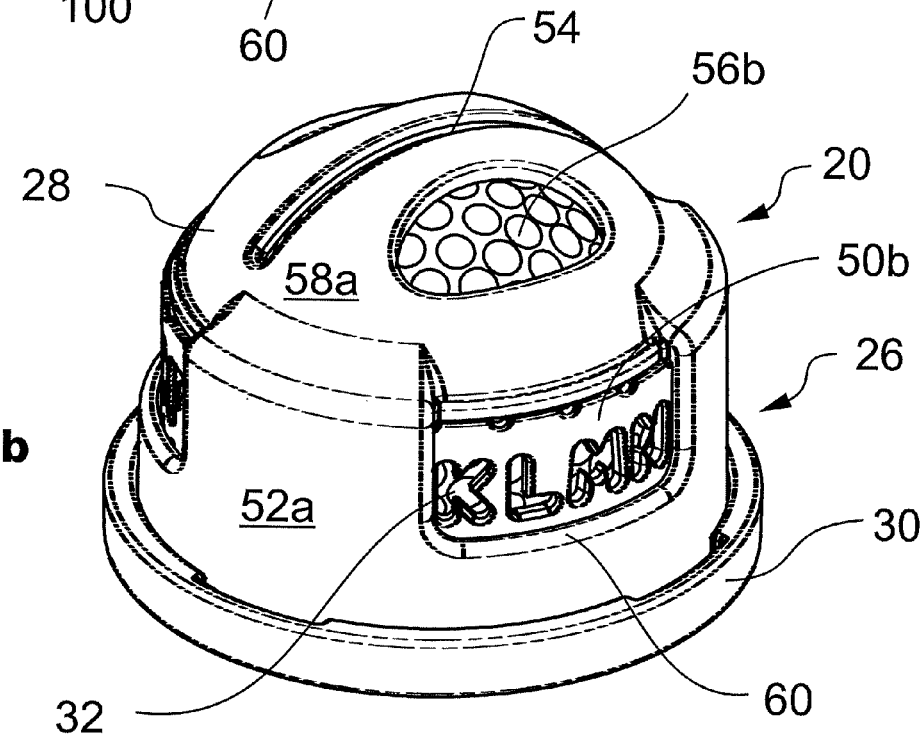
Figure 4A:
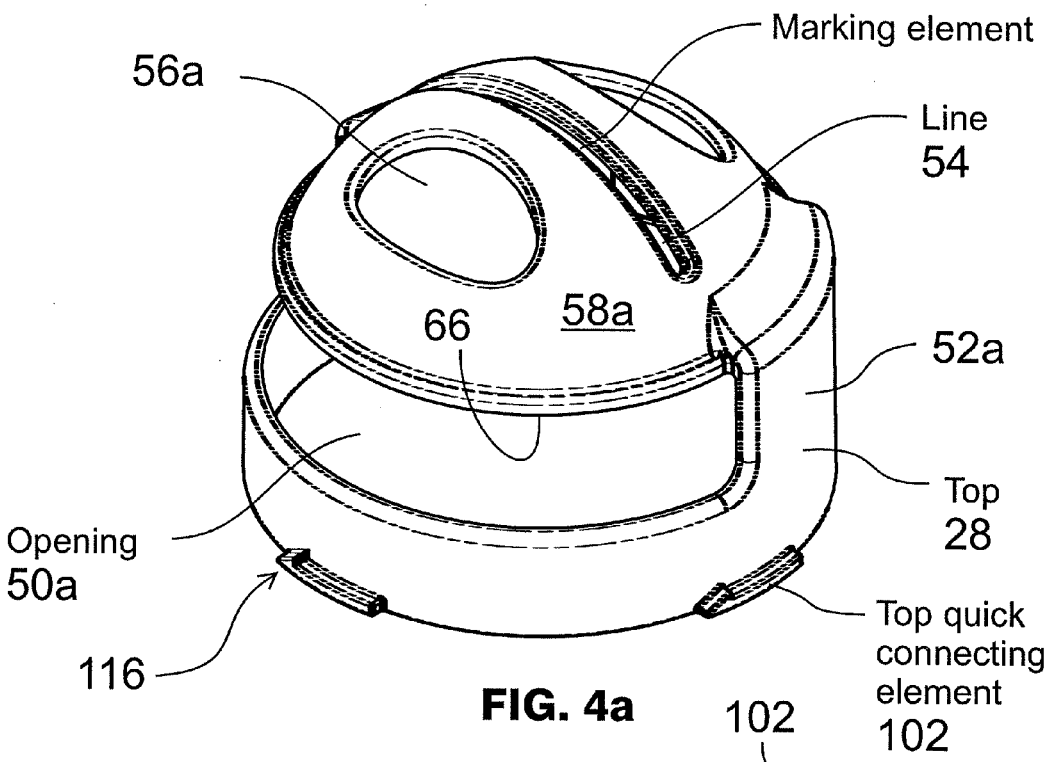
FIGS. 4*a* and 4*b* are three dimensional views of the top of the housing of the ball marking device of FIG. 1.
Figure 4B:
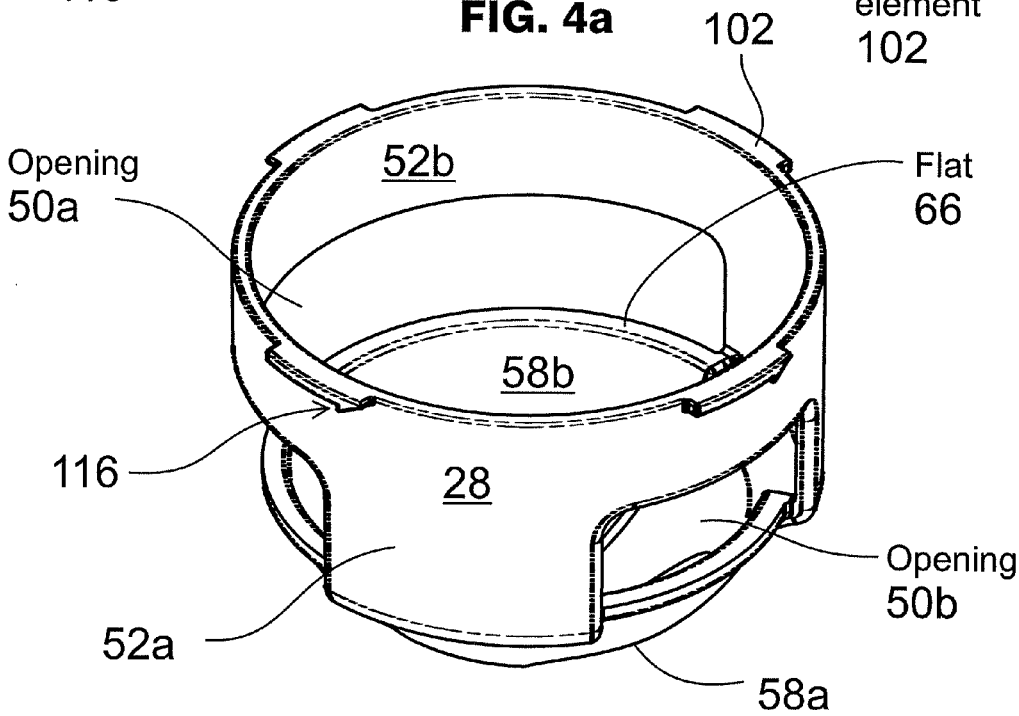
Figure 5A:
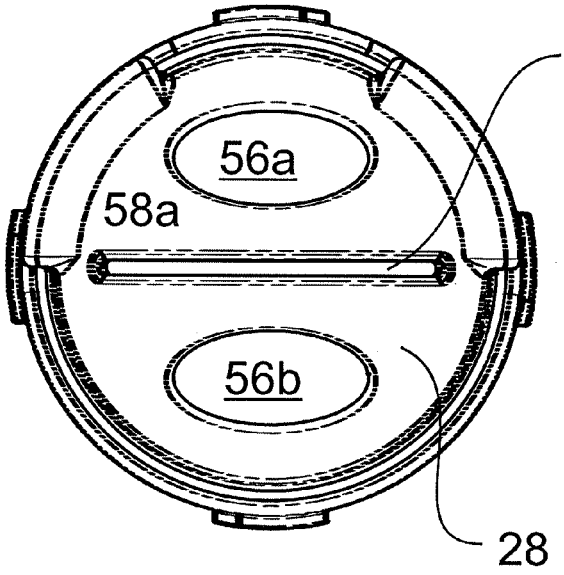
FIGS. 5*a*, 5*b*, and 5*c* are top and side views of the top of the housing of the ball marking device of FIG. 1.
Figure 5C:
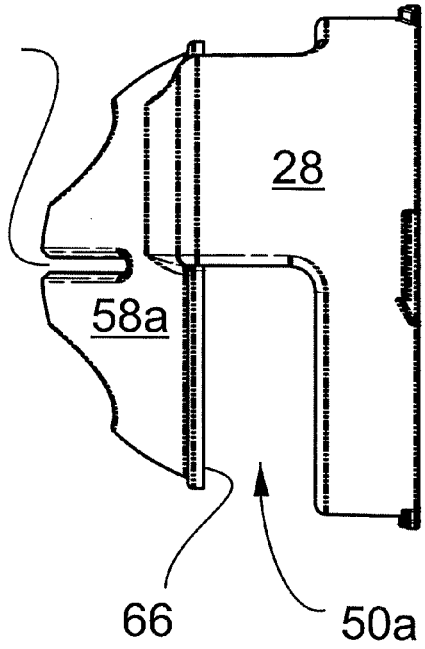
Figure 5B:
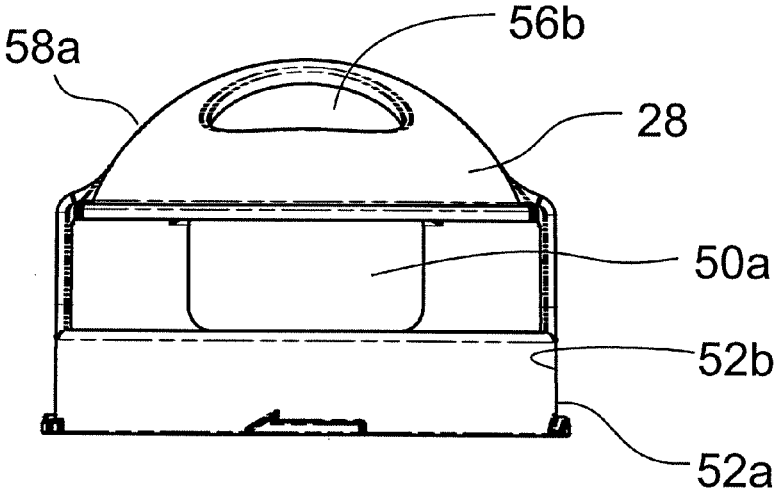
Figure 6:
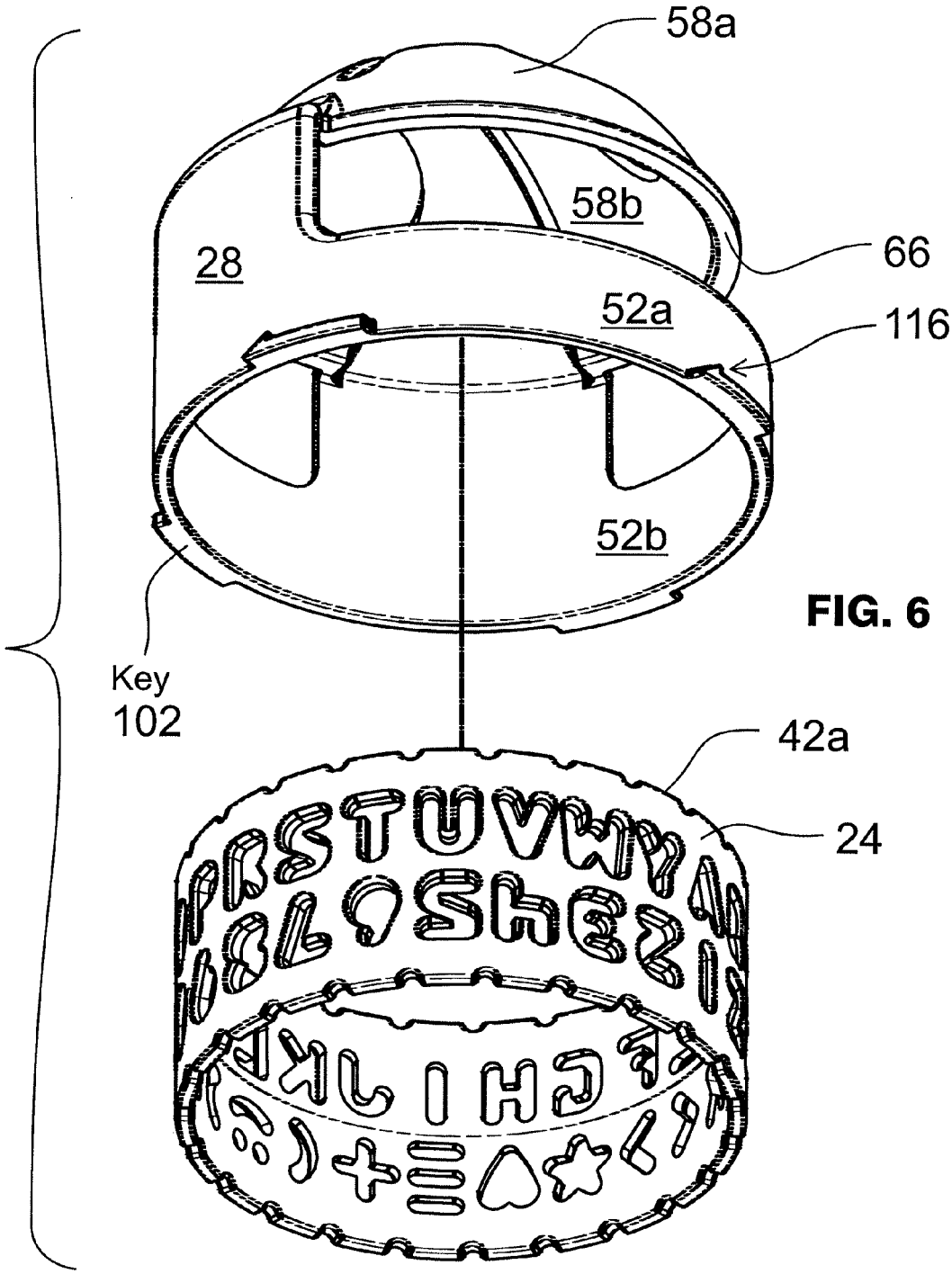
FIG. 6 is an exploded three dimensional view of the top of the housing and the stencil ring of the ball marking device of FIG. 1.
Figure 8A:
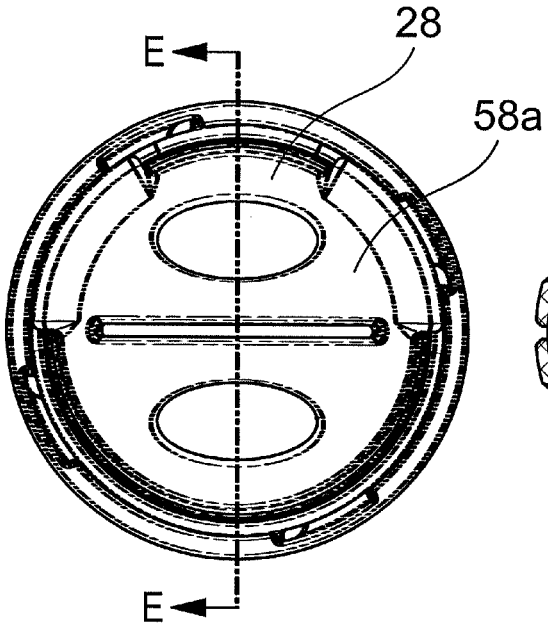
FIG. 8*a* is a top view of the housing of the ball marking device of FIG. 1.
Figure 8B:
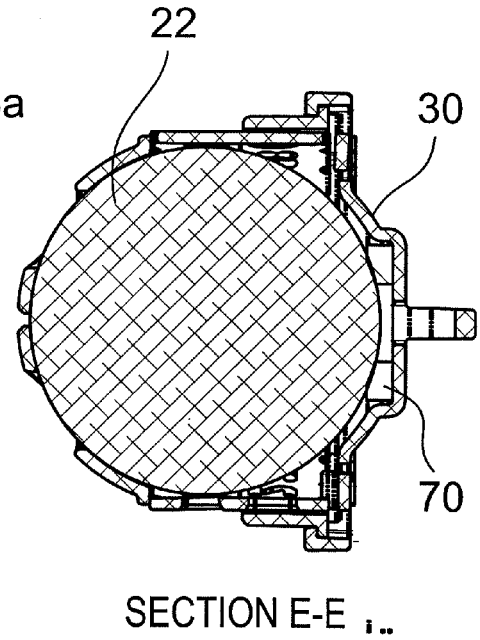
FIG. 8*b* is a cross sectional view of the housing of the ball marking device and the ball of FIG. 1 through section EE of FIG. 8*a;*
Figure 8C:
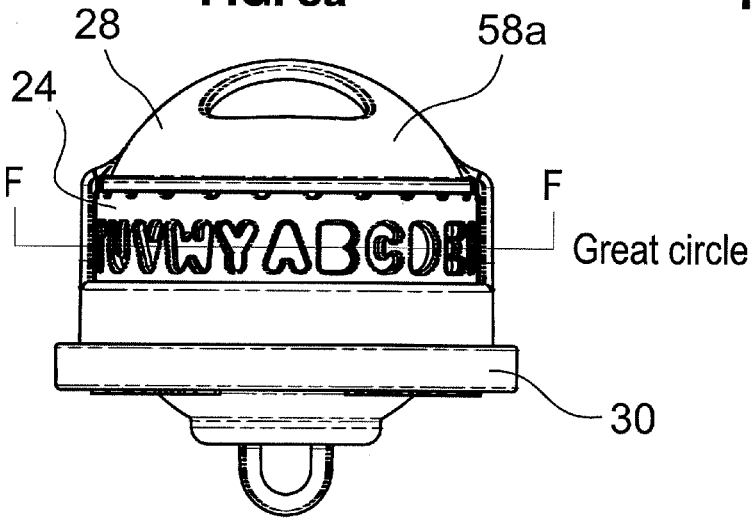
FIG. 8*c* is a side view of the housing and stencil ring of the ball marking device of FIG. 1.
Figure 9B:
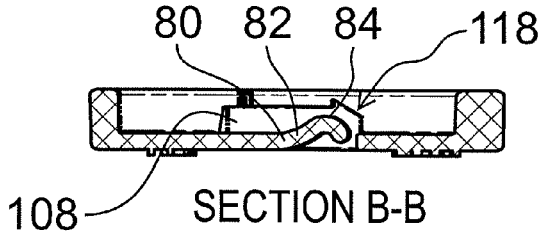
FIG. 9*b* is a cross sectional view of the base of the housing of the ball marking device of FIG. 1 through section BB of FIG. 9*a;*
Figure 9A:
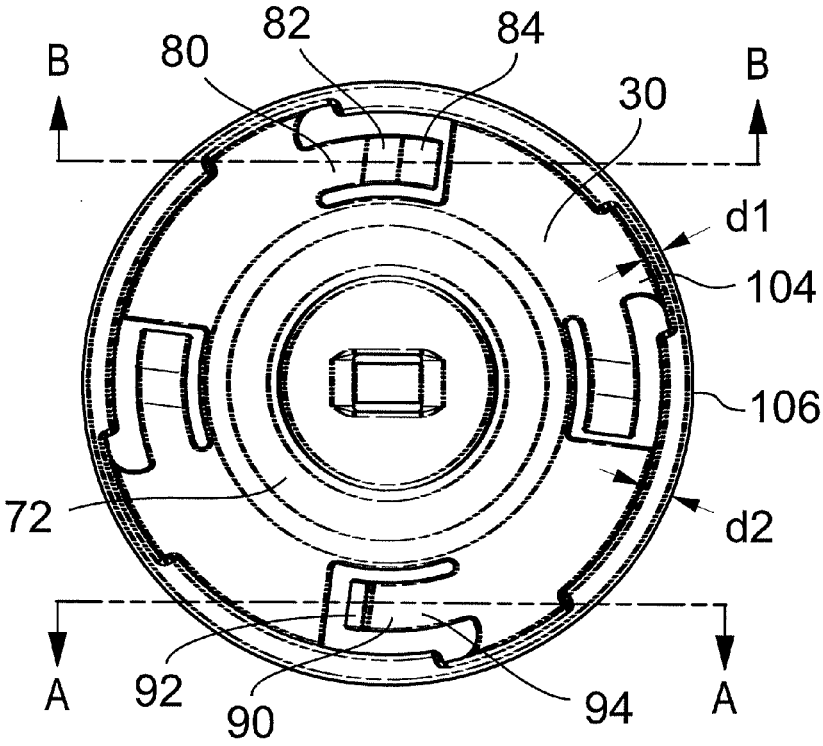
FIG. 9*a* is a top view of the base of the housing of the ball marking device of FIG. 1.
Figure 9D:
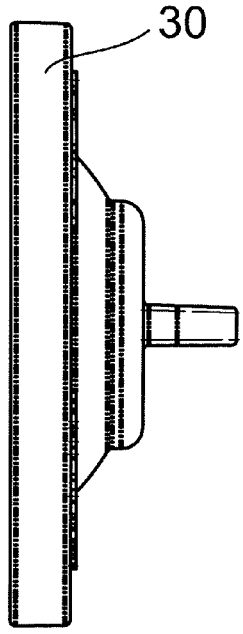
FIG. 9*d* is a side view of the base of the housing of the ball marking device of FIG. 1.
Figure 9C:
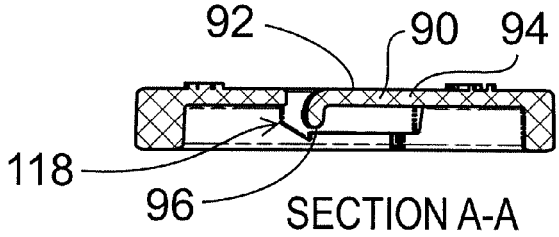
FIG. 9*c* is a cross sectional view of the base of the housing of the ball marking device of FIG. 1 through section AA of FIG. 9*a;*

Housing 26, including top 28 and base 30, enclose stencil ring 24 within which ball 22 is placed, as shown in FIGS. 3*a*, 3*b*. Top 28 includes openings 50*a*, 50*b* extending through top 28 from outside sidewall surface 52*a* to inside sidewall surface 52*b*, as shown in FIGS. 3*a*, 3*b*,4*a*, 4*b*, and 5*a*-5*c*. Stencil ring surface 34*a* with stencil symbols 32 of first row 40*a* or second row 40*b* is seen through openings 50*a*, 50*b* and accessed with a marker (not shown) to mark ball 22. In one embodiment, openings are positioned in top 28 so a great circle of ball 22 is centered in openings 50*a*, 50*b* and rows 40*a*, 40*b* of stencil ring 24 are positioned so centers of symbols 32 are also aligned with the center of openings 50*a*, 50*b* so symbols printed on ball 22 are located centered along a great circle of ball 22, as shown in FIG. 8*c*.

In one embodiment top 28 also includes marking elements, such as line 54 and shaped opening 56*a*, 56*b* that can also be used to mark ball 22. In the embodiment shown in the figures, these marking elements extend from outside rounded top surface 58*a* to inside rounded top surface 58*b*. In one embodiment, openings 50*a*, 50*b* have beveled edges, 60. Marking elements, including line 54 and shaped openings 56*a*, 56*b* can have similar beveled edges.

First edge 42*a* of stencil ring 24 fits against flat 66 on top 28, as shown in FIGS. 1, 4*a*, 4*b*, 5*c*, and 6. Flat 66 on top 28 allows first edge 42*a* of stencil ring 24 to freely rotate, sliding along its smooth surface.

Ball 22 fits within stencil ring 24 and extends to contact inside rounded top surface 58*b*. Since inside rounded top surface 58*b* is smooth, ball 22 can freely rotate, sliding against its surface.

Figure 7A:
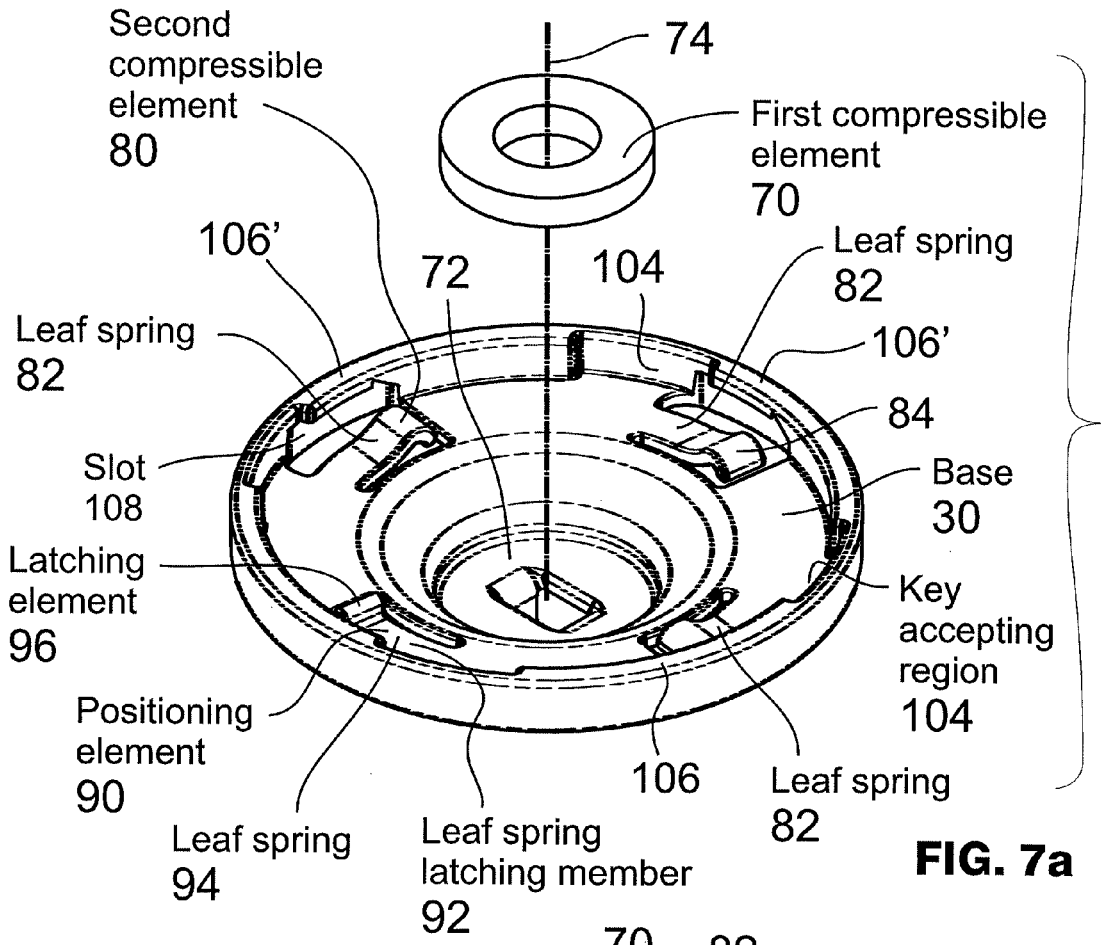
FIG. 7*a* is an exploded three dimensional view of the base of the housing and the first compressible element of the ball marking device of FIG. 1.
Figure 7B:
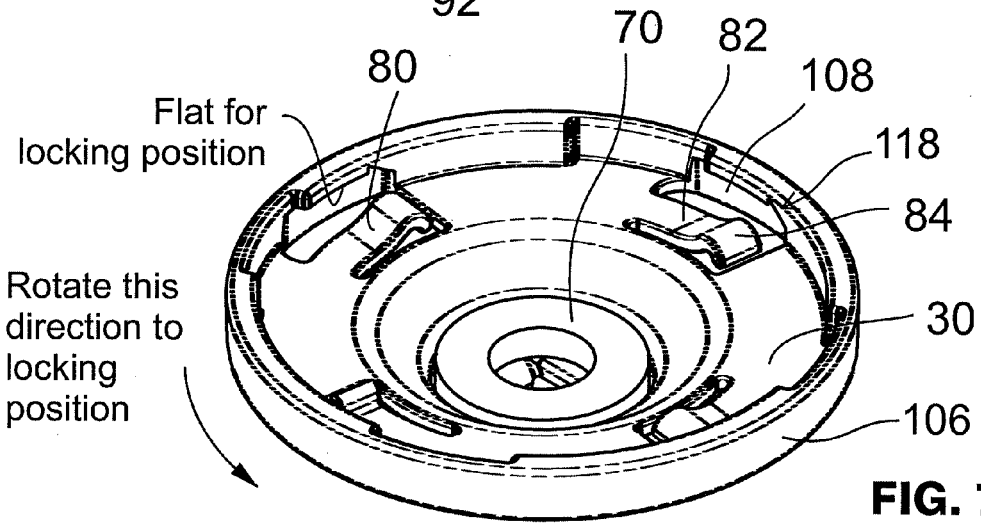
FIG. 7*b* is a three dimensional view of the base of the housing of the ball marking device of FIG. 1 with the first compressible element in place.

In one embodiment, base 30 includes first compressible element 70, such as a gasket, a rubber washer, or an o-ring, as shown in FIGS. 7*a*, 7*b*. In this embodiment, first compressible element 70 is adhesively attached to flat 72 of base 30 with an adhesive, such as 3M468, manufactured by 3M Company, St. Paul, Minn. When base 30 is securely fastened to top 28, first compressible element 70 is compressed by ball 22, as shown in FIG. 8*b*, restricting movement of ball 22 with respect to base 30. However, in this embodiment stencil ring 24 remains free to rotate, allowing stencil ring 24 to be positioned for marking stationary ball 22.

In one embodiment, base 30 also includes second compressible element 80, as shown in FIGS. 7*a*, 7*b*. In one embodiment base 30 includes a plurality of second compressible elements 80, as also shown in FIG. 7*a*. In this embodiment each second compressible element 80 includes leaf spring 82 that has surface 84 that presses against second edge 42*b* of stencil ring 24 toward flat 66 of top 28. Because of pressure exerted by the plurality of leaf springs 82 that make up second compressible element 80, stencil ring 24 is held firmly but rotatably in place against flat 66.

In one embodiment, base 30 also includes positioning element 90, as shown in FIGS. 7*a*, 7*b* and FIGS. 9*a*-9*c*. In one embodiment, positioning element 90 includes leaf spring latching member 92 that includes leaf spring 94 and latching element 96. Latching element 96 is sized to fit into grooves 46 of structure for incremental positioning 44 of stencil ring 24, allowing rotation of stencil ring 24 to fixed positions. These fixed positions are separated by a distance equal to the width of stencil symbol 32 plus the spacing between stencil symbols 32. These widths can vary depending on the width of a particular stencil symbol 32. For example spacing for the letter W may be greater than for the letter I. Stencil ring 24 can be rotated from one fixed position to the next by finger pressure on stencil ring 24 exerted through opening 50*a*, 50*b* sufficient to push stencil ring 24 past latching element 96. Now stencil ring 24 is free to rotate until latching element 96 falls into the next groove 46. Once it does, additional finger pressure can keep stencil ring 24 rotating so a desired symbol is positioned adjacent a symbol previously printed on ball 22.

Base 30 connects to top 28 with quick connect and quick release mechanism 100, as shown in FIGS. 1, 3*a*, 3*b*, 4*a*, 4*b*, and 7*a*, 7*b*. In this embodiment, quick connect and quick release mechanism 100 includes key 102 in top 28 and key accepting region 104 in base 30. In one embodiment, base 30 has sidewall 106 that has a thinner wall thickness d1 in key accepting region 104 than wall thickness d2 in other portions of sidewall 106. Thus, top 28 fits into base 30 when keys 102 of top 28 are positioned to fit into key accepting regions 104 of base 30. Base 30 also includes slots 108 extending through sidewall 106 adjacent key accepting regions 104. Slots 108 have a height about equal to thickness of keys 102 so that top 28 can be rotated with respect to base 30 moving keys 102 into slots 108 and under sidewall portion 106' having thicker wall thickness d2. Thus connecting top 28 and base 30. Disconnect is accomplished by reverse rotating top 28 with respect to base 30, rotating keys 102 from latched position under sidewall portion 106' back to key accepting regions 104 where top 28 can be separated from base 30.

Alternatively, quick connection can be accomplished with a threaded connection between top and base. In another embodiment, quick connection can be accomplished with a top that snaps to the base. For example, the top may have a portion with a raised ridge that fits into a groove extending around an inner surface of the base. Alternatively, the top can have a larger diameter than the base and have sufficient flexibility to be press fit onto the base.

Figure 10:
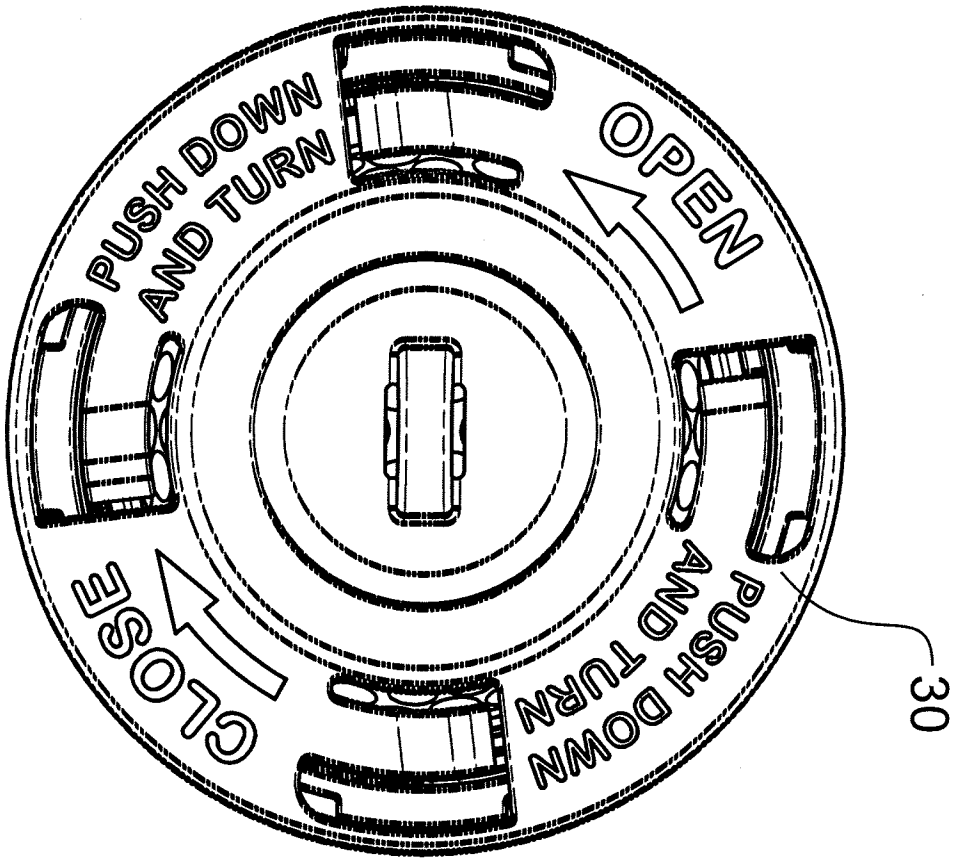
FIG. 10 is a bottom view of the base of the housing of the ball marking device of FIG. 1.

In one embodiment, keys 102 include half arrow heads 116, as shown in FIGS. 1, 4*a*, 4*b*, 6, while slots 108 include matching latching edges 118, as shown in FIGS. 7*a*, 7*b*, 9*b*, 9*c*. In this embodiment, twist connection provides top 28 latched to base 30. Removal is accomplished by pushing down on base 30 and twisting, and in one embodiment such instruction is provided on base 30, as shown in FIG. 10. Instruction as to which way to turn to open and close is also provided with arrows. These instructions may be printed or provided by lettering molded into outer surface of base 30.

Figures 11A, 11B, 11C, 11D:
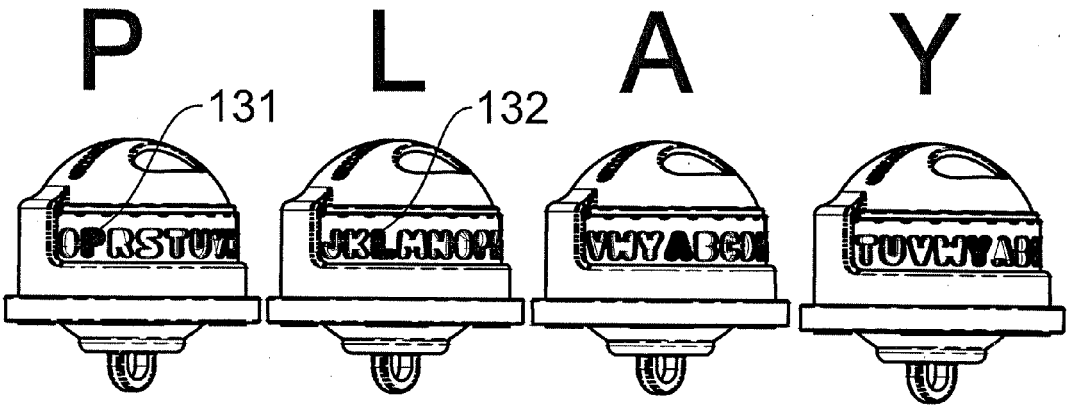
FIGS. 11*a*-11*h* are side views of the ball marking device of FIG. 1 showing steps for writing the phrase "play ball" on the ball.
Figures 11E, 11F, 11G, 11H:
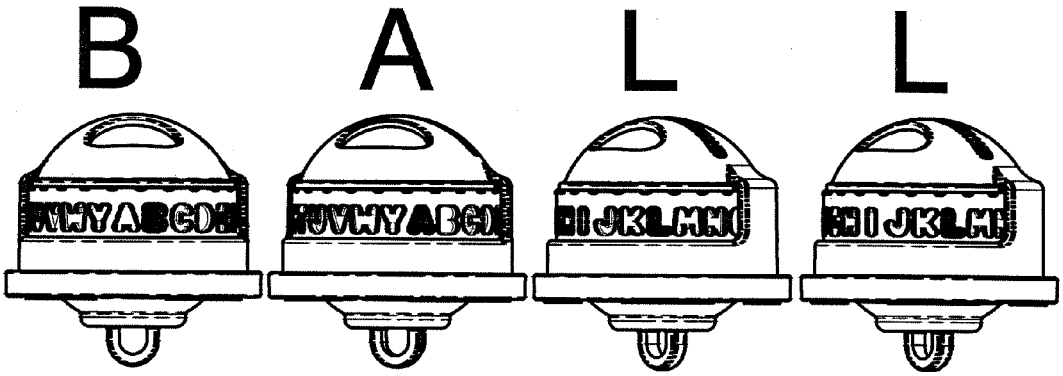
Figure 11I:
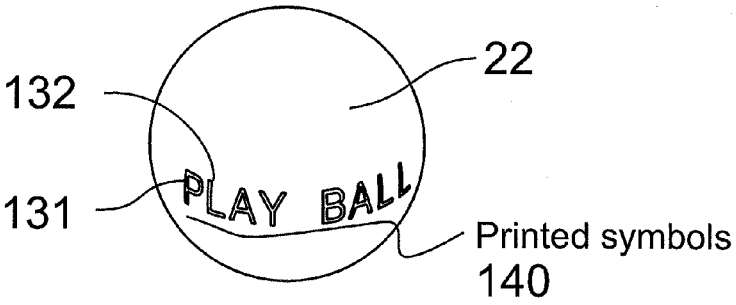
FIG. 11*i* is a three dimensional view of the ball of FIG. 1 showing the printed symbols of the phrase "play ball" after the writing steps of FIGS. 11*a*-11*h*.

In using ball marking device 20 for marking ball 22 the user first decides what he or she wants to write and inserts stencil ring 24 in top 28 so that the first desired stencil symbol 32 in first row 40*a* or second row 40*b* is visible right side up through openings 50*a*, 50*b*. The user then places ball 22 in top 28 inside stencil ring 24, places base 30 on ball 22 and connects top 28 to base 30. The user then rotates stencil ring 24 so the first desired stencil symbol 32 is located at the far left side of opening 50*a*. With a permanent marker or paint pen the user then fully fills in first desired stencil symbol 32 to create first printed symbol 131 on ball 22, as shown in FIG. 11*a*. The user then rotates stencil ring 24 so the second desired stencil symbol 32 is above ball 22 just to the right of already printed symbol 130. The user then fully fills in the second desired symbol 32 with the permanent marker or paint pen to create second printed symbol 132 on ball 22, as shown in FIG. 11*b*. The user then continues to rotate stencil ring 24 so the next desired stencil symbol 32 is above ball 22 just to the right of the last already printed symbol 132 and continues in this manner until all desired symbols have been printed on ball 22, as shown in FIGS. 11*c*-11*h*. The user can leave spaces between words. If a desired symbol is on a different row on stencil ring 24, the user opens the device, takes out the ball, takes out the stencil ring, inverts stencil ring 24, replaces the ball and stencil ring 24 back in top 28, then rotates the ball so already printed symbols are aligned with stencil symbols 32 in the proper row, then the user connects base 30 and continues printing symbols from this row. In one embodiment, letters are on one row of stencil ring 24 and other types of symbols are on the other row so in most cases removing the stencil ring can be avoided. In one embodiment, the most commonly used 24 letters were provided in one row and 24 other symbols in the other row. More or less can be provided by adjusting their size. Size of symbols can be different on the two rows and the spacing between incremental position grooves can be different on the two rows. The user can also use stencil elements on top 28 to add other marks, such as line 54, on ball 22. The user then removes base 30 from top 28, and removes finished ball 22, now with printed symbols 140, as shown in FIG. 11*i*.

While the disclosed methods and systems have been shown and described in connection with illustrated embodiments, various changes may be made therein without departing from the spirit and scope of the invention as defined in the appended claims.

The invention claimed is:

1. A device for marking a ball, comprising a stencil ring and a housing, wherein said housing includes a base and a top, wherein said base includes a base quick connecting element and wherein said top includes a top quick connecting element, wherein said base and said top quick connecting elements are for connecting and disconnecting said base to said top, wherein said housing encloses said stencil ring when said base and said top quick connecting elements are connected, wherein said stencil ring has a cylindrical shape and includes stencil symbols, wherein said base and said top are sized to hold the ball for marking with said stencil symbols when said base and said top quick connecting elements are connected.

2. A device as recited in claim 1, wherein said stencil ring is rotatable within said housing.

3. A device as recited in claim 1, wherein said stencil ring includes a structure for incremental positioning.

4. A device as recited in claim 3, wherein said base includes a positioning element for engaging with said structure for incremental positioning.

5. A device as recited in claim 4, wherein said a positioning element for engaging with said structure for incremental positioning includes a latching element and a spring.

6. A device as recited in claim 5, wherein said latching element and said spring are integrated in a single structure.

7. A device as recited in claim 6, wherein said latching element and said spring are integrated in a leaf spring latching element.

8. A device as recited in claim 3, wherein said structure for incremental positioning includes grooves.

9. A device as recited in claim 8, wherein said grooves are located on an edge of said stencil ring.

10. A device as recited in claim 9, wherein said grooves are located on two edges of said stencil ring.

11. A device as recited in claim 1, wherein said stencil ring includes a first row of stencil symbols.

12. A device as recited in claim 11, wherein said stencil ring further includes a second row of stencil symbols.

13. A device as recited in claim 12, wherein said second row of stencil symbols are inverted with respect to said first row of stencil symbols.

14. A device as recited in claim 1, wherein said stencil ring is located to provide symbols on the ball extending approximately around a great circle of the ball.

15. A device as recited in claim 1, wherein said base includes a first compressible element for holding the ball securely between said base and said top.

16. A device as recited in claim 15, wherein said first compressible element includes a gasket.

17. A device as recited in claim 1, wherein said base includes a second compressible element for holding said stencil ring securely between said base and said top.

18. A device as recited in claim 17, wherein said second compressible element includes a spring.

19. A device as recited in claim 18, wherein said spring includes a leaf spring.

20. A device as recited in claim 19, wherein said leaf spring is molded into said base.

21. A device as recited in claim 20, further comprising a plurality of said leaf springs molded into said base.

22. A device as recited in claim 1, wherein said base quick connecting element includes a slot and a flat.

23. A device as recited in claim 22, wherein said top quick connecting element includes a key that fits into said slot.

24. A device as recited in claim 1, wherein said base quick connecting element rotatably connects with said top quick connecting element.

25. A device as recited in claim 1, wherein said top includes an opening positioned for accessing said stencil ring.

26. A device as recited in claim 25, wherein said top includes a plurality of openings positioned for accessing said stencil ring.

27. A device as recited in claim 1, wherein said top includes a marking element.

28. A device as recited in claim 27, wherein said marking element includes a line.

29. A device as recited in claim 1, wherein said top includes a flat for receiving said stencil ring.

30. A device as recited in claim 29, wherein said flat for receiving said stencil ring extends around said top.

31. A device as recited in claim 1, wherein said stencil ring includes an axis, wherein said top includes a flat for receiving said stencil ring, wherein said base includes a second compressible element for holding said stencil ring securely between said base and said flat, wherein said second compressible element allows said stencil ring to rotate around said axis.

32. A device for marking a ball, comprising a housing and a stencil ring, wherein said housing holds said stencil ring and the ball, wherein said stencil ring includes a fixed positioning structure that provides incremental positioning, wherein said housing includes a first element allowing said stencil ring to rotate between fixed positions defined by said fixed positioning structure, and wherein said housing includes a second element for holding the ball from rotating, and wherein said stencil ring has a cylindrical shape and includes a plurality of stencil symbols for marking the ball.

33. A method of marking a ball with a marker, comprising:

a. providing a housing and a stencil ring, wherein said housing includes a base and a top, wherein said stencil ring is in said housing, wherein said stencil ring has a cylindrical shape and includes a first stencil symbol and a second stencil symbol, wherein the ball fits in said stencil ring and in said housing;

b. inserting the ball into said housing wherein said housing includes an element to hold the ball from rotating;

c. rotating said stencil ring to position said first stencil symbol on the ball; and d. using a marker and said stencil ring to mark said first stencil symbol on the ball.

34. A method as recited in claim 33, comprising further rotating said ring to position said second stencil symbol on the ball and using the marker and said stencil ring to mark said second stencil symbol on the ball.

* * * * *